United States Patent [19]

Black et al.

[11] 3,973,493

[45] Aug. 10, 1976

[54] WEB STENCILLING AND DRYING APPARATUS

[75] Inventors: James A. Black, Kent City; Harry Russell Farwell, Cedar Springs, both of Mich.

[73] Assignee: James A. Black, Kent City, Mich.

[22] Filed: Nov. 1, 1974

[21] Appl. No.: 519,822

[52] U.S. Cl. ..... 101/126; 34/155; 226/29

[51] Int. Cl.[2] ..... B41F 15/24; B65H 23/00; F26B 13/10

[58] Field of Search ..... 101/114, 115, 123, 124, 101/126, 416, 181, 196; 34/155; 226/29, 30, 21, 33, 39; 83/278

[56] References Cited

UNITED STATES PATENTS

| | | | |
|---|---|---|---|
| 2,565,570 | 8/1951 | Messinger | 101/416 A |
| 2,725,101 | 11/1955 | VonHofe | 83/278 X |
| 3,221,646 | 12/1965 | Hardy, Jr. et al. | 101/115 |
| 3,318,018 | 5/1967 | Steele et al. | 101/416 R X |
| 3,499,233 | 3/1970 | Black | 101/115 X |
| 3,848,528 | 11/1974 | Scedorf | 101/115 |

*Primary Examiner*—Edgar S. Burr
*Assistant Examiner*—R. E. Suter
*Attorney, Agent, or Firm*—Price, Heneveld, Huizenga & Cooper

[57] ABSTRACT

Web stencilling and drying apparatus for web stock with at least one intermittent feed stencilling station and slit registry means for stock therefor, a continuous feed ultraviolet drying station, and first and second dynamic flow pressure differential web controllers upstream and downstream of the ultraviolet drying station, the first one including sensors responsive to the length of the web loop therein to control web intermittently fed thereto and continuously fed therefrom.

3 Claims, 6 Drawing Figures

WEB STENCILLING AND DRYING APPARATUS

BACKGROUND OF THE INVENTION

This invention relates to stencilling of web stock.

Screen stencilling of stock is well known for coating materials such as inks, adhesives, and/or other functional and/or decorative deposits on stock in a selected pattern by forcing the material through a stencil screen pattern. Example products of the process are posters, decalcomania, graphic designs, adhesive patterns and the like. Sometimes only one coating is applied, while often multiple coatings, e.g. of multiple colors, are applied in successive stencilling steps, each layer being dried before applying the subsequent coating.

The drying step for each coating normally requires substantial space and time, tending to limit the speed of the entire operation, as well as tremendously increasing the equipment size and expense. The complexities caused by this factor are further compounded when stencilling and then drying web stock using concentrated heat on localized web areas, by the necessity of feeding the web stock intermittently through the stencilling station and then continuously through the drying station to prevent overheating of the localized web areas.

SUMMARY OF THE INVENTION

The web stencilling and drying apparatus of this invention effectuates controlled stencilling of intermittently fed web stock, and subsequent rapid and simple drying of continuously fed stencilled web stock. The control of the web stock changed from intermittent feed to continuous feed is with a pressure differential controller upstream of the dryer, through which the web advances in loop form. The web is also held in proper tension by this controller which operates with another such controller downstream of the dryer to hold the stock in correct position on a rotating feed drum in the dryer.

The provision of these features constitutes an important object of this invention.

The rotational speed of the dryer drum is governed in accordance with the amount of web slack in the tension controller upstream thereof, while this upstream web slack is retained in loop form under a dynamic flow, pressure differential thereacross. The web stock downstream of the dryer is also retained in loop form regulated by the second dynamic flow pressure differential applied thereacross.

These and other objects, advantages, and features of the invention will be apparent from the following detailed description in conjunction with the drawings.

DESCRIPTION OF THE PREFERRED EMBODIMENT

Figure 1:
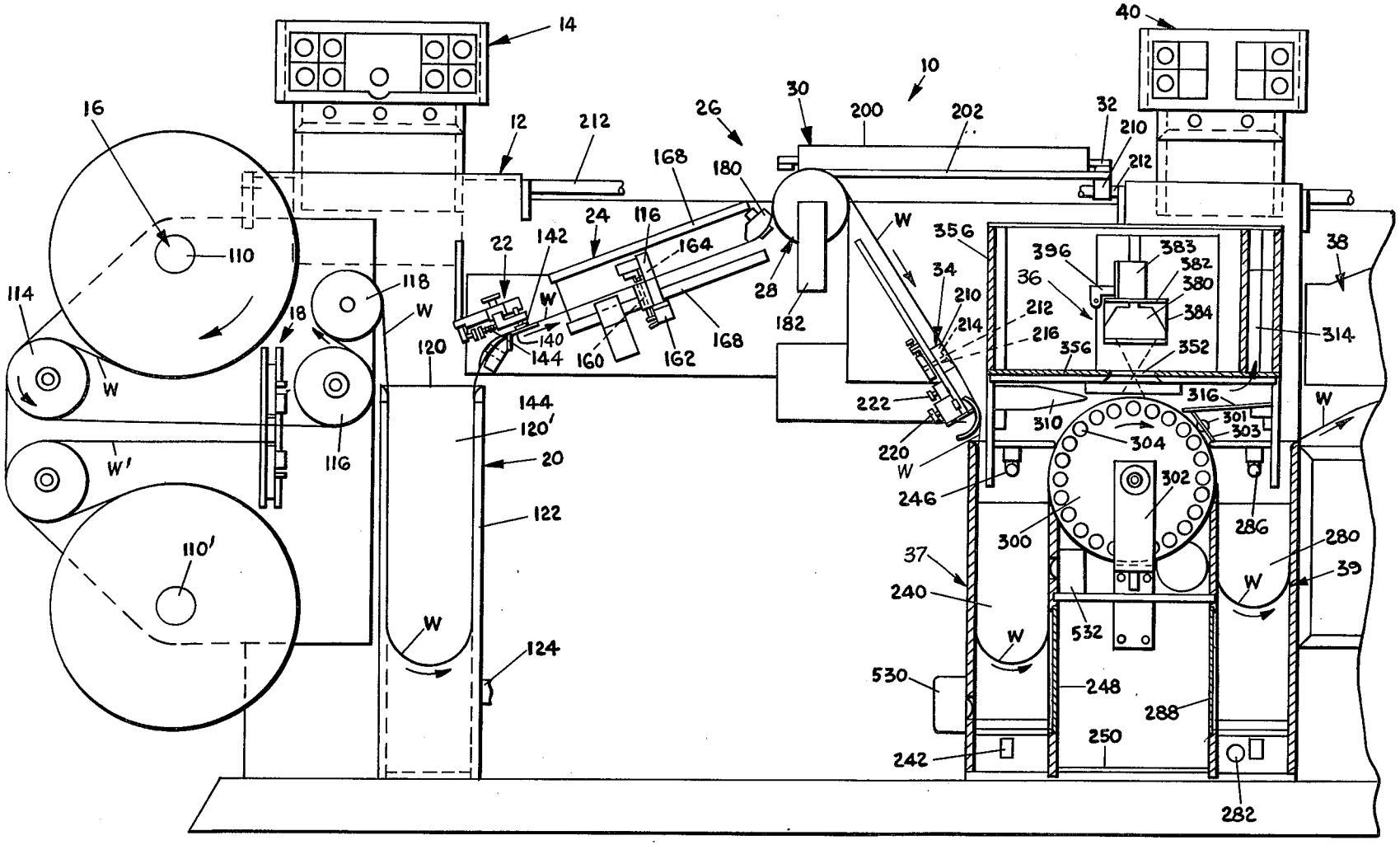
FIG. 1 is a side elevational view of the apparatus of this invention.

Referring now specifically to the drawings, the combination 10 depicted in FIG. 1 includes a general support housing and framework subassembly 12, a master control console subassembly 14 thereon, reel web stock spindle supply subassembly 16, splicer subassembly 18, pressure differential control unit 20, vacuum web pull-back subassembly 22, register slit forming subassembly 24, stencilling station 26 including imprint cylinder subassembly 28, stencil screen frame subassembly 30, carriage subassembly 32, web register subassembly 34, and ultraviolet radiation drying subassembly 36. Subsequent operation subassembly 38 such as a second stencilling mechanism, with a console subassembly 40 for such subsequent operation apparatus, is partially depicted for illustrative purposes.

The web stock supporting spindle subassembly 16 may be of any conventional type, including one or two stock support spindles 110 and 110' for reels of the alternate web stock W and W'. Stock W is shown being used first, with alternate stock W' being in reserve. The web stock W from the reel on spindle 110 (FIG. 1) is guided around suitable rotational guide roll 114 and through a conventional splicer subassembly 18 for splicing the tailend of one web to the leading edge of the following web. A pair of guide rolls 116 and 118 are positioned to orient web W into open top 120 of a chamber 120' formed within housing 122 of subassembly 20.

The web stock W is advanced down one lateral wall of housing 122, and back up the opposite lateral wall, in a U-shaped loop pattern within the chamber. An exhaust outlet 124 at the bottom of housing 122 is preferably operably associated with a vacuum source (not shown) so that a dynamic air flow will occur by entry of air through open top 120 and down across the upper inner surface of web W, around the clearance between the edges of the web and the ends of housing 122 and out exhaust 124. The resulting pressure differential caused by this dynamic flow retains the stock in this U-shaped loop to govern feed to the apparatus, prevent wrinkling, control the tension thereon, and remove any excess moisture. Further details of this pressure differential controller, sometimes called a "vacuum dancer" are set forth in copending U.S. patent application Ser. No. 515,639 filed Oct. 17, 1974 by James A. Black and Harry Russell Farwell, entitled VERTICAL DRYER, incorporated by reference herein and now abandoned.

After passage through subassembly 20, web W passes between a lower guide surface 140 and an upper vacuum pullback subassembly 22 which includes suction elements 142 reciprocable longitudinally, relative to the direction of web movement, to apply a reverse pulling action and tension on the web extending through the stencilling station 26 to registration subassembly 34. The suction elements 142 are communicant with a vacuum source (not shown) and reciprocable by a suitable actuator such as an air cylinder or mechanical shifter against the bias of return springs 144. Downstream of pull-back device 22 is web registry slitting subassembly 24. This slitting subassembly cuts one or more transversely oriented registration slits through the web stock by the reciprocation of a lower cutting element 160 vertically upwardly alongside a stationary upper cutting element 164 above the web. The element 160 is shifted by actuator 162. These cutting elements are mounted to support 166 which is adjustable along the rails 168. Further details of the registry slitting subassembly 24 are described in detail in copending U.S. patent application Ser. No. 519,691, filed Oct. 31, 1974, by James A. Black and Harry Russell Farwell entitled WEB SLIT REGISTRY, which is incorporated by reference herein.

The web stock travels to the stencilling station 26 as around a suitable guide 180. The stencilling station includes a support surface such as an impression cylinder 28 (FIG. 1) rotationally mounted on supports 182 for rotation with linear advancement of the stencil screen frame subassembly 30 during stencilling of the web.

The stencil screen frame subassembly 30 includes a peripheral frame element 200 serving as a support for the stencil screen 202 stretched across its undersurface in conventional fashion adjacent the crown of impression cylinder 28 and retaining the stencilling fluid in conventional fashion. The frame is mounted on a conventional carriage subassembly 32 which in turn is mounted by bearings 210 on horizontally oriented guide rods 212 adjacent the top of cylinder 28 to enable the stencil frame and screen to be reciprocated longitudinally forwardly and rearwardly at the crown of the impression cylinder.

Downstream of the stencilling station is the slit registry subassembly 34 (FIG. 1). This subassembly includes a female element 210 which has stock engaging surface with a recess 212 therein. An abutment registration shoulder 214 is on the upstream end of the recess, relative to web movement. A vacuum conduit 216 communicates with the bottom of the recess and with a suitable vacuum source (not shown). The edge of the web stock immediately adjacent the transverse slit formed by subassembly 24 thus can be offset along with adjacent web area, transversely out of the plane of the web stock into the recess by the pressure differential caused with application of suction in the recess. Thus, slight reverse motion of the web by subassembly 22 will cause this offset edge to engage the registration surface 214 oriented transversely of the web advancement, to arrest the web against further reverse motion caused by the suction and accurately position the web stock on imprint cylinder 28. This registration element 210 can be adjusted laterally relative to web advancement by control knob 220. Gross longitudinal adjustments of element 210 are achieved by control knob 222, and fine longitudinal adjustments by control knob 224, all as described in further detail in copending U.S. patent application Ser. No. 519,591 identified above.

Figure 4:
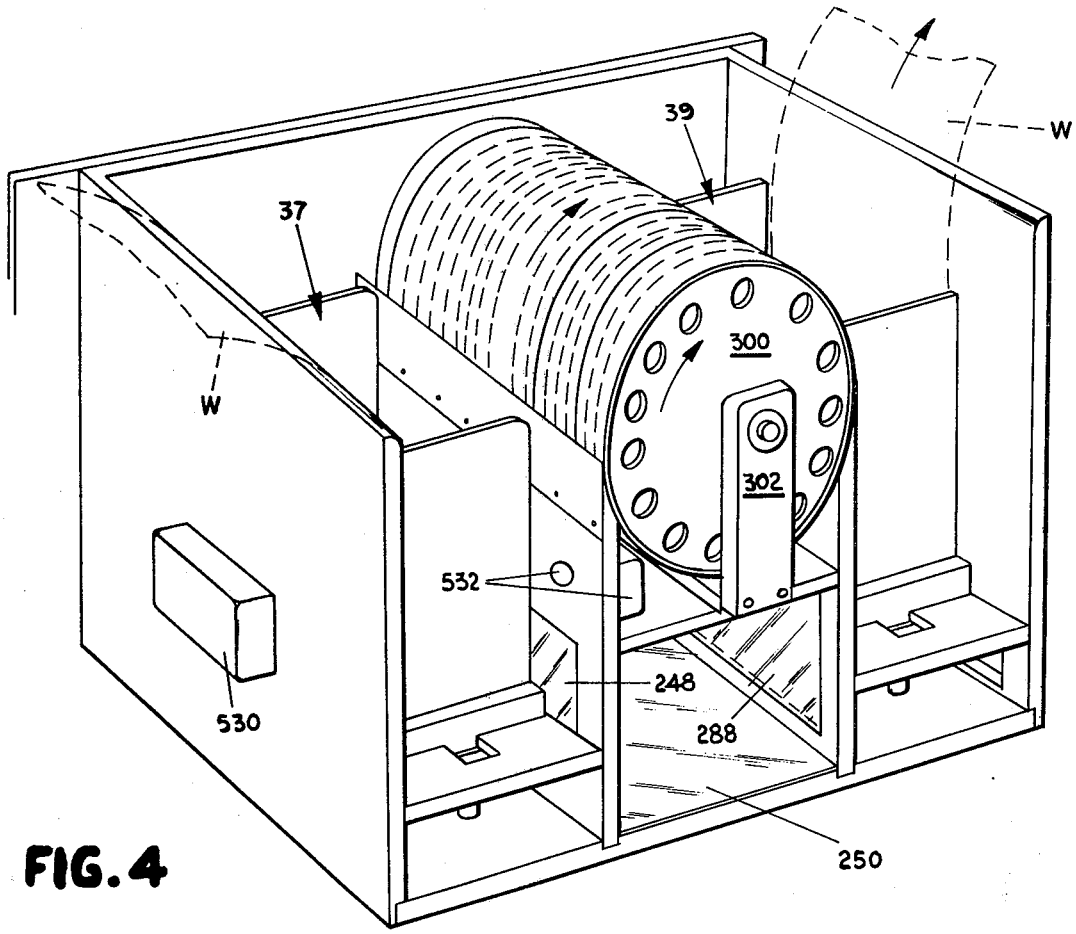
FIG. 4 is a perspective view of the lower portion of the dryer apparatus in the combination in FIG. 1.

Downstream of registration subassembly 34, the web stock enters the web dryer complex. This complex includes the drying subassembly 36 previously identified, and a pair of dryer drum-straddling, control subassemblies 37 and 39 (FIGS. 1 and 4). Subassemblies 37 and 39 include open top chambers 240 and 280 respectively, which have vertical side walls for engagement of the web in U-shaped loop patterns in the chambers, end walls, and suction outlet means 242 and 282 respectively at the bottom of the chambers, i.e. opposite the openings thereof. This arrangement causes continuous dynamic air flow into the open tops of the chambers, across the surface of the web loops, down around the edges of the web through the clearance between the web loops and the ends of the chambers, and through the suction outlet or exhaust.

Between units 37 and 39 is a continuously driven dryer drum 300 rotatably mounted on supports 302 so that web stock W leaving control unit 37 will pass up over the crown of the drum and down into unit 39. Ventilation openings 304 are provided in the axial ends of the drum for cooling purposes. Cooling of the drum periphery and stock thereon is achieved by a laterally elongated outlet of air nozzle 310 oriented tangentially to the upper crown of the drum surface. Besides cooling the stock and drum, this air flow also entrains vapors of solvents or the like from the wet fluid on the stock during the drying process, and carries them over deflector plate 316 and up through the outlet 314. Above chambers 240 and 280 is a respective pair of conventional lights 246 and 286 to illuminate these chambers for observation of the web loops therein, such observation being through the inner glass walls 248 and 288 using the reflecting bottom surface mirror 250 inbetween these walls.

Figure 5B:
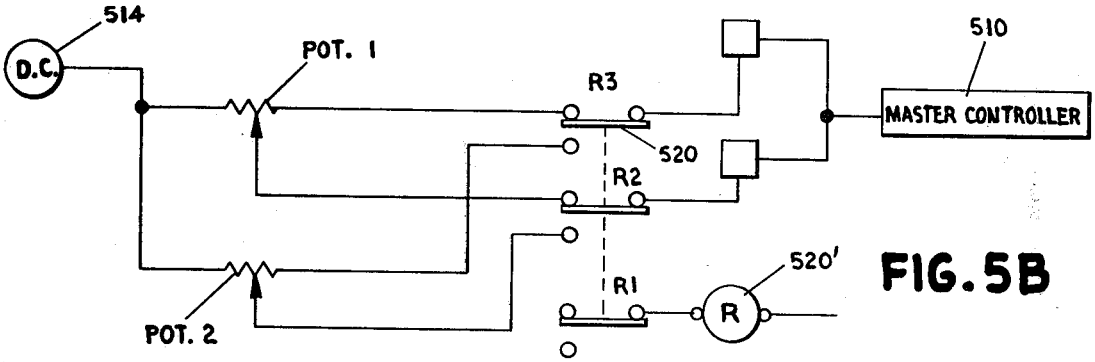
FIG. 5*b* is another partial circuit diagram for the drum drive.

Drum 300 is driven by a conventional DC motor, the motor speed being controlled by conventional Master Controller 510 (FIG. 5B). The conventional potentiometer which comes with this unit has been removed and replaced by a double pot having a single shaft for adjustment control. The wiper on one of the pots is advanced approximately 20% with respect to the wiper on the other pot for reasons to be discussed hereinafter.

Drum 300 is continuously rotated to feed web stock out of pressure differential control unit 37 into unit 39 and thus past the concentrated radiant heat (explained hereinafter relative to heat source 380) applied to the localized area of the web stock at the crown of the drum. The rotational speed of the motor and the drum 300 (FIGS. 4 and 5B) which it drives is controlled by the magnitude of the DC signal applied to Master Controller 510 (FIG. 5B) as is conventional. The magnitude of this DC signal supplied from source 514 is dependent upon whether connection is made through potentiometer pot 1 of potentiometer pot 2, the former causing a lesser magnitude (approximately 20 percent as noted previously) to flow to Master Controller 510 and thus a slower rotational speed of the motor and drum assembly. The selection of one potentiometer or the other is determined by the throwing of a two-positioned, three-pole relay switch 520, the relay actuating coil 520′ being intermittently connected to a suitable source of AC signal as described hereinafter and latched in its energized condition by contacts R1.

Relay coil 520′ (FIGS. 5A and 5B) is actuated by a pair of photoelectric sensor units mounted in chamber 240 of control 37, photoelectric sensor 530 being toward the bottom of the chamber (FIG. 1) and photoelectric sensor 532 being spaced upwardly therefrom intermediate the top and bottom of the chamber. Bottom sensor 530 is normally open and top sensor 532 is normally closed. With top photo sensor 532 closed, and bottom photoelectric sensor 530 open, the circuit will be closed through potentiometer pot 1 (FIG. 5A) to cause the drum to operate at the slower of the two speeds which have been preselected by adjustment of the shaft controlling pots 1 and 2 of the potentiometer.

Figure 5A:
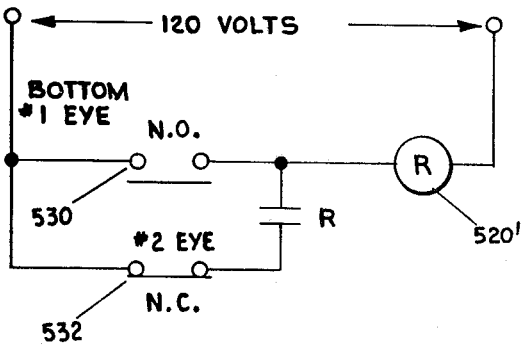
FIG. 5*a* is a partial circuit diagram of the photoelectric sensor control circuit for the dryer drum drive.

The web stock is intermittently fed into chamber 240 from the stencilling and registration subassemblies. If the loop in chamber 240 becomes sufficiently long to approach the bottom of chamber 240 and, thus, be detected by bottom photoelectric sensor 530, sensor 530 will close, energizing relay coil 520′ with AC power as illustrated in FIG. 5A. Energization of relay coil 520' will shift the relay contacts R1, R2 and R3, series connecting pot 2 in and disconnecting pot 1 from the DC supply to the Master Controller. Since pot 2 has a resistance approximately 20% lower than pot 1, the magnitude of the DC signal to Master Controller 510 will be increased and the drum rotated at a faster speed, (approximately 20%), thus pulling the web out of chamber 240 more rapidly, causing the bight of the loop to rise.

The increased speed of the motor will fairly rapidly pull the bight of the loop out of registry with photoelectric sensor 530. Relay coil 520' will remain actuated, however, until the loop also comes out of registry with normally closed upper photoelectric sensor 532 because of the latching effect achieved by contacts R1. Once the bight of the loop rises above sensor 532, the AC circuit to relay coil 520' will be de-energized, the series connection of pots 1 and 2 to Master Controller 510 interchanged, and the drum rotation slowed until such point as the bight of the loop again descends to registry with sensor 530.

The length of the loop is thus controlled so that its bight will remain generally between sensor 532 and sensor 530. Thus, the drum will continuously feed stock past the high radiant heat source without the stock stopping thereat, even though the web stock received from the stencilling station is intermittent in motion because of the necessity to repeatedly stop the web at the stencilling station during registry. Keeping the loop of web in the chamber enables it to be controlled by the dynamic gaseous pressure differential applied thereto. The two motor speeds can be adjusted equally by rotation of the single potentiometer shaft or relatively by increased or decreased differential positioning of the wipers. A relative differential of approximately 20% has been found satisfactory as previously noted. If the particular web stock being advanced through the dryer tends to slip on the driven rotating drum, the frictional relation therebetween can be increased. An effective way of doing this is by resting a row of freely rotatable, like metal balls 301 on the upper surface of the web stock to press it against the upper half of the drum 300. These balls may be suitably held as by a matrix bracket 303. The balls and bracket can be as shown in detail in the upper row in FIGS. 2 and 4 of U.S. Pat. No. 3,510,035, for example.

Figure 2:
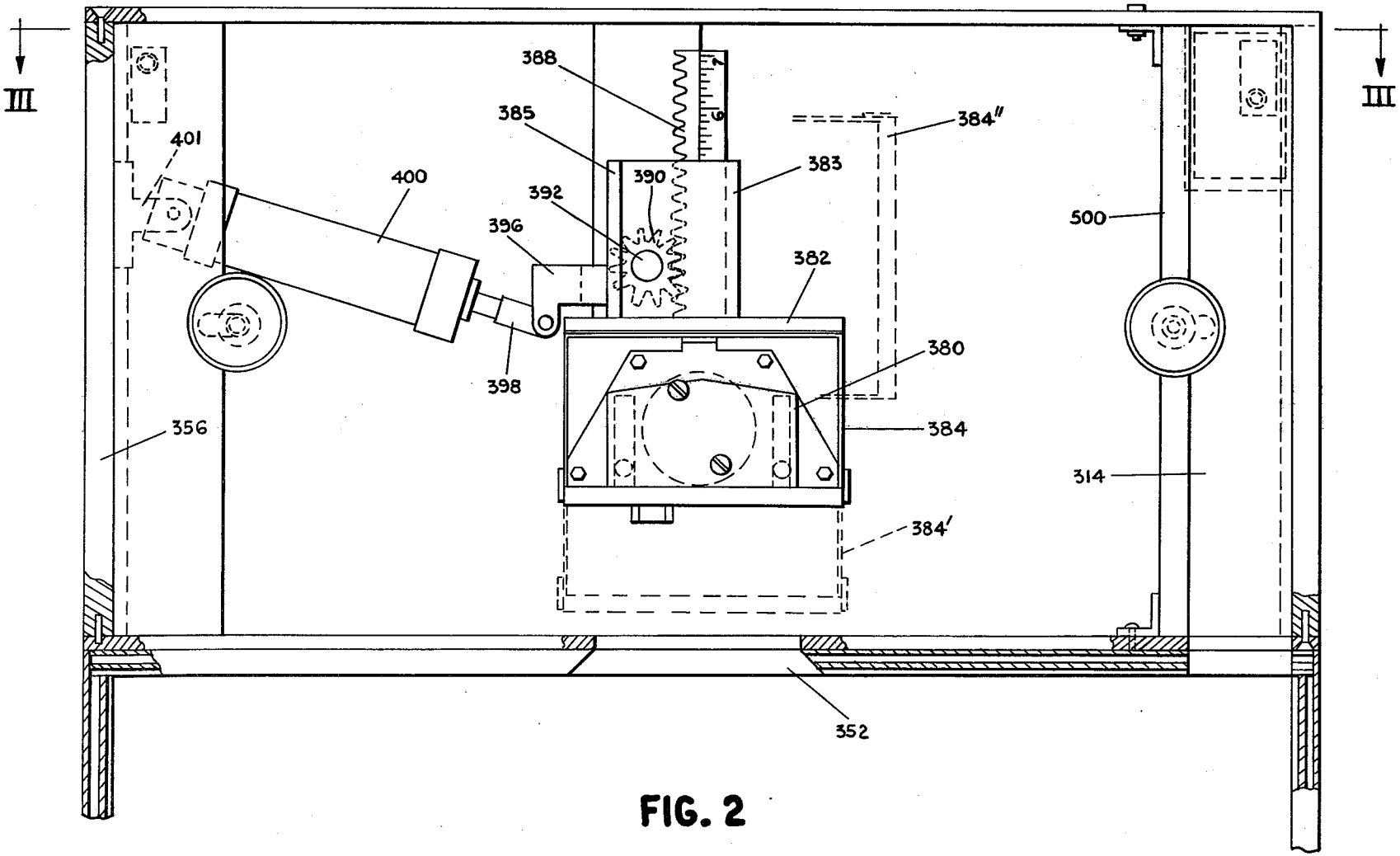
FIG. 2 is a somewhat enlarged, partial side elevational view of the upper portion of the dryer apparatus of this invention.
Figure 3:
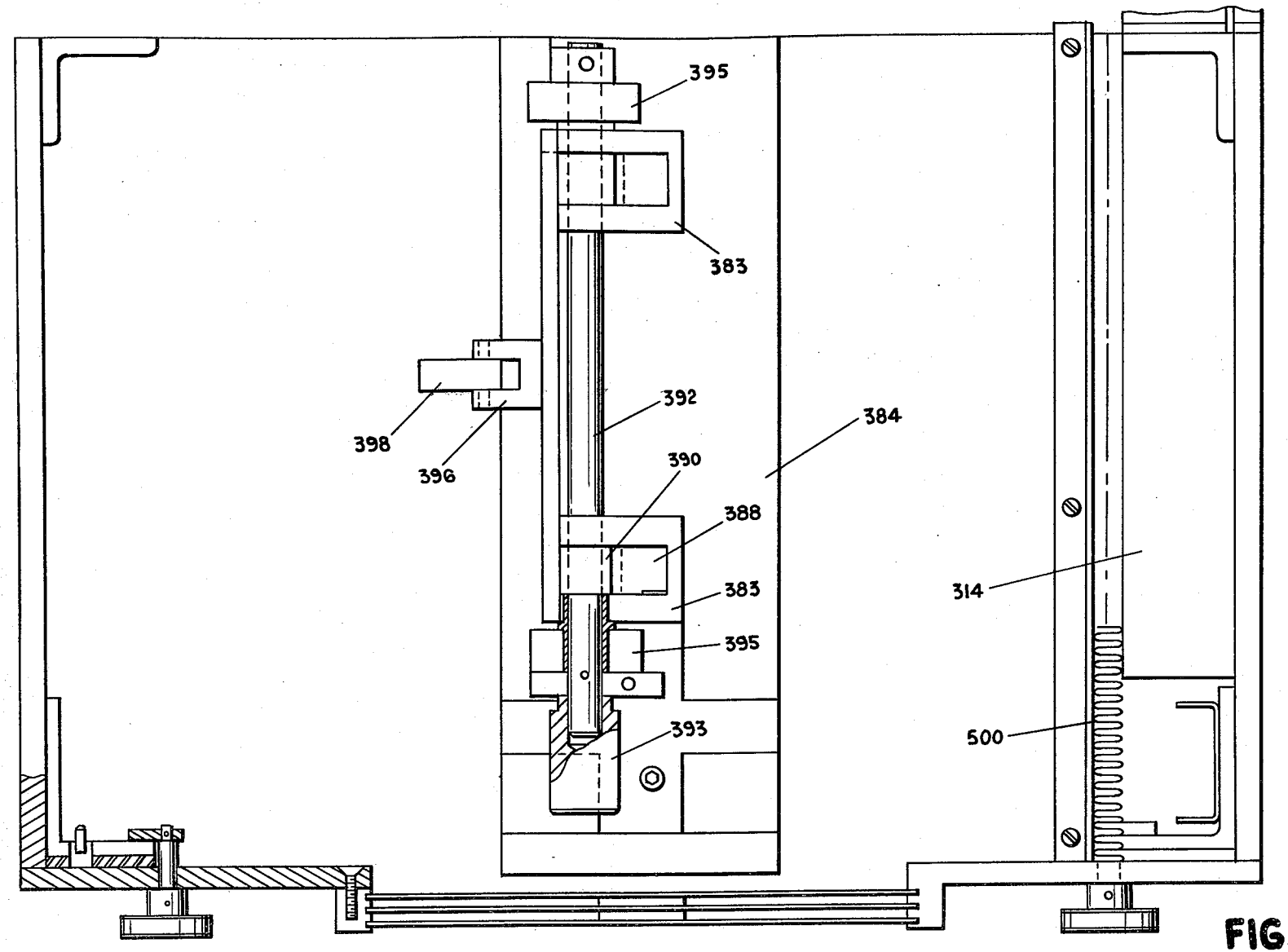
FIG. 3 is a sectional view of the apparatus in FIG. 2, taken on plane III—III.

Above drum 300 is a horizontal partition 350 having a central elongated opening 352 extending along the crown of drum 300. A housing 356 above this partition encloses an ultraviolet radiant heat source 380 of a conventional quartz-type or the like. This source is mounted on a transversely extending horizontal plate 382 in turn suspended from a pair of spaced brackets 383 pivotally mounted on transverse horizontal shaft 392. Attached to both of these brackets is a vertical plate 385 to which an L-shaped yoke 396 is secured. Pivotally attached to one leg of this L-shaped yoke is the extended piston rod 398 of a fluid cylinder 400 having its opposite end pivotally attached at bracket 401 to housing 356 (FIG. 2). Extension of fluid cylinder 400 thus shifts the entire assembly around shaft 392 to orient the radiation heat source away from opening 352 and the crown of the drum and any web stock thereon, and toward a convoluted heat sink 500 (FIG. 2 and FIG. 3) extending vertically along the exhaust discharge passageway 314. This alternate position of the source is shown in dotted lines 384''. Thus, if the continuous movement of the web through the dryer should be halted for some reason, the high intensity heat source can be quickly oriented away from it to prevent possible overheating and damage to the web.

The vertical position of the heat source can be varied to change its spacing from the drum and stock by a gear and rack arrangement. Specifically, a spur gear 390 keyed to shaft 392 engages a vertical gear rack 388 that extends down through plate 382 and suspends shield 384 and source 380 therefrom. Thus, rotation of shaft 392 by knob 393 rotates gear 390 to raise or lower rack 388 and the source and shield a controlled amount as indicated by the scale on rack 388, between the solid lines indicated at 384, and the dotted lines at 384'.

Thus, in operation of the apparatus, the web stock W from the reel is guided around roll 114 (FIG. 1), through splicer subassembly 18, around rolls 116 and 118, in U-shaped loop form through pressure differential control subassembly 20, past the vacuum pull-back subassembly 22, through the registry slitter subassembly 24, and over the impression cylinder. The web is repeatedly advanced during stencilling with rotation of cylinder 28 and linear advancement of stencil screen frame 30 on its carriage 32, followed by stopping of the web stock, momentary reversal thereof by subassembly 24 for registration at subassembly 34 by engagement of the offset web edge, adjacent the formed slit, with shoulder 214 and then again advanced for stencilling. The web is thus intermittently fed into dynamic pressure differential controller 37 which continuously feeds it to the UV dryer. The pair of controllers 37 and 39 astraddle the dryer drum maintain the web in constant tension over the drum while the web is continuously advanced past the radiant heat source to be dried, and also cooled by the air flow therepast. The feed of the web over the drum is constantly controlled by the two speed motor drive to the drum, governed by the upper and lower photoelectric web loop sensors.

Certain additional advantages and features of the invention will be readily apparent to those in the art upon studying the above illustrative embodiment thereof. The depicted structure can be modified in various fashions to suit a particular type of usage, stock, coating material, or the like. These obvious variations are considered to be part of the inventive concept which is intended to be limited only by the scope of the appended claims and the reasonable equivalent structures to those defined therein.

The embodiments of the invention in which an exclusive property or privilege is claimed are defined as follows:

1. Stencilling apparatus for web stock comprising:

at least one stencilling station including means for stencilling web stock;

web slit registry means for repeatedly registering web stock portions at said stencilling station;

a drying station downstream of said stencilling station and downstream of said web slit registry means, including web guiding means for guiding said web stock therethrough; and pressure differential control means downstream of said stencilling station and of said web slit registry means, and upstream of said drying station for receiving and retaining a loop of said web stock between said stencilling station and said drying station, including means for applying a pressure differential across said web stock loop with dynamic gaseous flow; said web guiding means for said drying station comprising a rotational drum, and including variable power means for rotating said drum at differing faster and slower speeds; web loop sensor means at said pressure differential control means for sensing maximum and minimum positions of said web loop, and being electrically connected with said drum rotating power means for causing said drum rotating power means to operate at slower and faster speeds when respective maximum and minimum web loop positions are sensed; said web slit registry means having slit forming means operable on said web stock for creating a transverse slit and two adjacent web stock edges, stock offsetting means for offsetting the stock adjacent said slit and offsetting at least one of said web stock edges out of the plane of said web stock; means for shifting said web stock in reverse; edge engaging means for engaging said one offset edge for registry of said web stock when said web stock is shifted in reverse; said offsetting means comprising means for forming a gaseous pressure differential across said web stock adjacent said slit.

2. Stencilling apparatus for web stock comprising:

at least one stencilling station including means for stencilling web stock;

web slit registry means for repeatedly registering web stock portions at said stencilling station;

a drying station downstream of said stencilling station and downstream of said web slit registry means, including web guiding means for guiding said web stock therethrough; and pressure differential control means downstream of said stencilling station and of said web slit registry means, and upstream of said drying station for receiving and retaining a loop of said web stock between said stencilling station and said drying station, including means for applying a pressure differential across said web stock loop with dynamic gaseous flow; said web slit registry means having slit forming means operable on said web stock for creating a transverse slit and two adjacent web stock edges, stock offsetting means for offsetting the stock adjacent said slit and offsetting at least one of said web stock edges out of the plane of said web stock; means for shifting said web stock in reverse; edge engaging means for engaging said one offset edge for registry of said web stock when said web stock is shifted in reverse; said offsetting means comprising means for forming a pressure differential across said web stock adjacent said slit; said offsetting means including a configurated recess adjacent said edge engaging means and cooperative with said offsetting means for forming a gaseous pressure differential for offsetting said web stock into said configurated recess.

3. Stencilling apparatus for web stock comprising:

at least one stencilling station including means for stencilling web stock;

web slit registry means for repeatedly registering web stock portions at said stencilling station;

a drying station downstream of said stencilling station and downstream of said web slit registry means, including web guiding means for guiding said web stock therethrough; and pressure differential control means downstream of said stencilling station and of said web slit registry means, and upstream of said drying station for receiving and retaining a loop of said web stock between said stencilling station and said drying station, including means for applying a pressure differential across said web stock loop with dynamic gaseous flow; said web slit registry means having slit forming means operable on said web stock for creating a transverse slit and two adjacent web stock edges, stock offsetting means for offsetting the stock adjacent said slit and offsetting at least one of said web stock edges out of the plane of said web stock; means for shifting said web stock in reverse; edge engaging means for engaging said one offset edge for registry of said web stock when said web stock is shifted in reverse; said offsetting means comprising means for forming a gaseous pressure differential across said web stock adjacent said slit.

* * * * *